United States Patent [19]

Wirth

[11] Patent Number: 4,724,804

[45] Date of Patent: Feb. 16, 1988

[54] ENGINE VALVE TRAIN MODULE

[75] Inventor: Rick C. Wirth, Henrietta, N.Y.

[73] Assignee: General Motors Corporation, Detroit, Mich.

[21] Appl. No.: 18,179

[22] Filed: Feb. 24, 1987

[51] Int. Cl.[4] ..... F01L 1/12

[52] U.S. Cl. ..... 123/90.39; 123/90.41; 123/90.44

[58] Field of Search ..... 123/90.39, 90.41, 90.44, 123/90.1

[56] References Cited

U.S. PATENT DOCUMENTS

| | | | |
|---|---|---|---|
| 3,138,146 | 6/1964 | Hutchison | 123/90.39 |
| 3,870,024 | 3/1975 | Ridgeway | 123/90.41 |
| 4,086,887 | 5/1978 | Schoonover et al. | 123/90.39 |
| 4,401,064 | 8/1983 | Nakamura et al. | 123/90.44 |
| 4,488,520 | 12/1984 | Almor | 123/90.39 |
| 4,653,441 | 3/1987 | Belsanti | 123/90.39 |

FOREIGN PATENT DOCUMENTS

| | | | |
|---|---|---|---|
| 165612 | 10/1982 | Japan | 123/90.39 |
| 210307 | 12/1983 | Japan | 123/90.39 |

*Primary Examiner*—Ira S. Lazarus

*Attorney, Agent, or Firm*—Arthur N. Krein

[57] ABSTRACT

A valve train module with rocker positioner and non-rotation guide has the rocker positioner and non-rotation guide in the form of a longitudinally extending U-shaped member with lateral outward extending rocker shaft supports adapted to retain a pair of rocker shafts in parallel spaced apart relationship to each other, with each of the rocker shafts pivotably supporting a plurality of rocker arms thereon actuated by hydraulic roller valve lifters operated by an engine driven camshaft for the valves in the cylinder head for a bank of cylinders, the U-shaped member having a base and parallel upright side walls with the base having bolt receiving apertures for its attachment to a cylinder head and each of the walls having at least a plurality of spaced apart pierced openings defined in part by sets of spaced apart inward extending rocker guide flanges to effect the pivotal positioning of an associate rocker arm, the base further having spaced apertures arranged to operatively receive an associate flat sided hydraulic roller valve lifter such that the upright side walls act as a non-rotation guide for the associate hydraulic roller valve lifter.

3 Claims, 6 Drawing Figures

ENGINE VALVE TRAIN MODULE

FIELD OF THE INVENTION

This invention relates to an engine valve train and, in particular, to an engine valve train module with rocker positioner and non-rotation guide used to position rocker arms on rocker shafts so as to effect operation of the intake and exhaust valves for a bank of cylinders in an internal combustion engine.

DESCRIPTION OF THE PRIOR ART

Various arrangements have been used in internal combustion engines of the type having rocker arms pivotably supported on a rocker shaft to effect axial positioning of the rocker arms on the associate rocker shaft. For example, wear pads pressed against the rocker shaft and having two ears thereon or flanged tubular spacers have been used to effect such axial alignment of the rocker arms on the rocker shaft.

However, the desirability to effect a reduction in the cost of manufacturing the valve trains in this type of engine while at the same time effecting an improvement in the reliability of the valve train components has been recognized. One factor which is presently being considered as a means to reduce such costs and to improve reliability is in the increased use of valve train subassemblies which can be directly attached, for example, to the cylinder head of an engine either manually by an assembler or by means of robotic equipment.

SUMMARY OF THE INVENTION

The present invention relates to a valve train module for a bank of cylinders of an internal combustion engine, the valve train module including a rocker positioner with anti-rotation guide which is adapted to locate a pair of parallel spaced apart, rocker shafts, with one of the rocker shafts pivotably supporting the rocker arms used to effect operation of the intake valves and the other rocker shaft pivotably supporting the rocker arms used to effect operation of the exhaust valves for the respective associate cylinders, each of the rocker arms being actuated by an associate cam driven hydraulic lash adjuster lifter and the rocker positioner being formed to prevent rotation of the lash adjuster lifters, the arrangement being such that the valve train module can be assembled, tested and then shipped as a unit assembly to an engine plant for direct operative attachment to the cylinder head of an engine.

It is therefore a primary object of this invention to provide an improved engine valve train which is adapted to be assembled as a valve train module that can then be tested as a unit assembly and shipped, if necessary, prior to its attachment to the cylinder head for a bank of in-line cylinders of an internal combustion engine.

Another object of this invention is to provide an improved valve train for an engine, the valve train being assembled as a module with a rocker positioner and anti-rotation guide locating a pair of rocker shafts pivotably supporting rocker arms positioned by the rocker positioner whereby they are operatively located so as to effect operation of associate intake and exhaust valves for the respective cylinders in an in-line bank of cylinders, the rocker positioner also being operative as an anti-rotation device for the cam actuated hydraulic lash adjuster lifters used to operate the rocker arms.

For a better understanding of the invention as well as other objects and further features thereof, reference is had to the following detailed description of the invention to be read in connection with the accompanying drawings.

DESCRIPTION OF THE PREFERRED EMBODIMENT OF THE INVENTION

Referring now to the Figures, the preferred embodiments of the valve train modules with rocker positioner with lifter anti-rotation device of the invention is shown, for purpose of illustration only, as being for use for a bank of four cylinders in an in-line 4-cylinder internal combustion engine of the type having the rocker arms actuated by hydraulic lash adjuster type valve roller lifters reciprocated by an engine driven camshaft.

Figure 1:
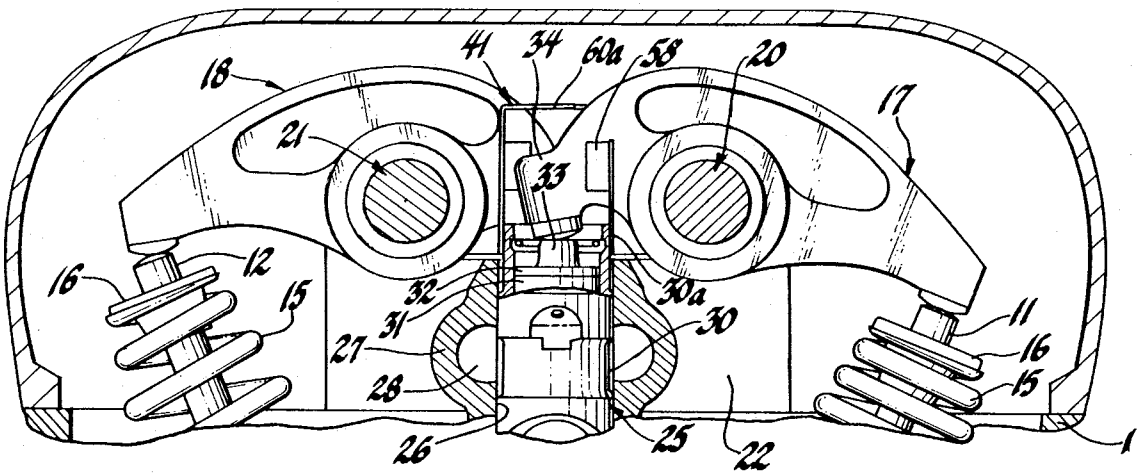
FIG. 1 is a cross-sectional view of a portion of an engine showing the valve train for an in-line bank of cylinders and having a preferred embodiment of a valve train module with rocker positioner and lifter anti-rotation device in accordance with the invention incorporated therein.

Referring now to FIG. 1, there is shown a portion of such an engine which, as conventional, has an engine block means a row of in-line cylinders therein defined in part by a cylinder head 1.

A pair of longitudinally spaced apart, poppet type, inlet valves 11, only one of which is shown, have their respective stems reciprocably guided in suitable valve stem guide bores, not shown, provided in the cylinder head 1 for movement to open or close an associate inlet port, not shown, in the cylinder head for a respective cylinder, not shown. Laterally spaced from each pair of inlet valves 11 is a poppet type, exhaust valve 12 having its stem reciprocably guided in a similar valve stem guide bore, not shown, for movement to open or close an associate exhaust port, not shown, in the cylinder head 1 for the associate cylinder, not shown.

As conventional, each of the inlet valves 11 and exhaust valve 12, for each cylinder, are normally biased to a valve closed position by an associate valve return spring 15. One end of such a spring 15 is in abutment against a surface of the cylinder head 1 while its opposite end abuts against a suitable spring retainer 16 fixed in a conventional manner adjacent to the upper free end of an associate stem of the respective inlet valve 11 or exhaust valve 12.

Each inlet valve 11 is actuated by an associate rocker arm 17 pivotably mounted, in a conventional manner intermediate its ends, on a rocker shaft 20, while each exhaust valve 12 is actuated by an associate rocker arm 18 pivotably mounted intermediate its ends on a rocker shaft 21. In the construction shown, the rocker shafts are solid and therefore lubrication of the rocker arms is by spray lubrication in a manner well known in the art and accordingly it is not deemed necessary to describe such a spray lubrication system since it does not relate specifically to the invention disclosed herein. It should however be realized, that, as well known in the art, the rocker shafts 20, 21 could be of the hollow type to effect direct lubrication of the rocker arms in a manner well known in the art.

Figure 2:
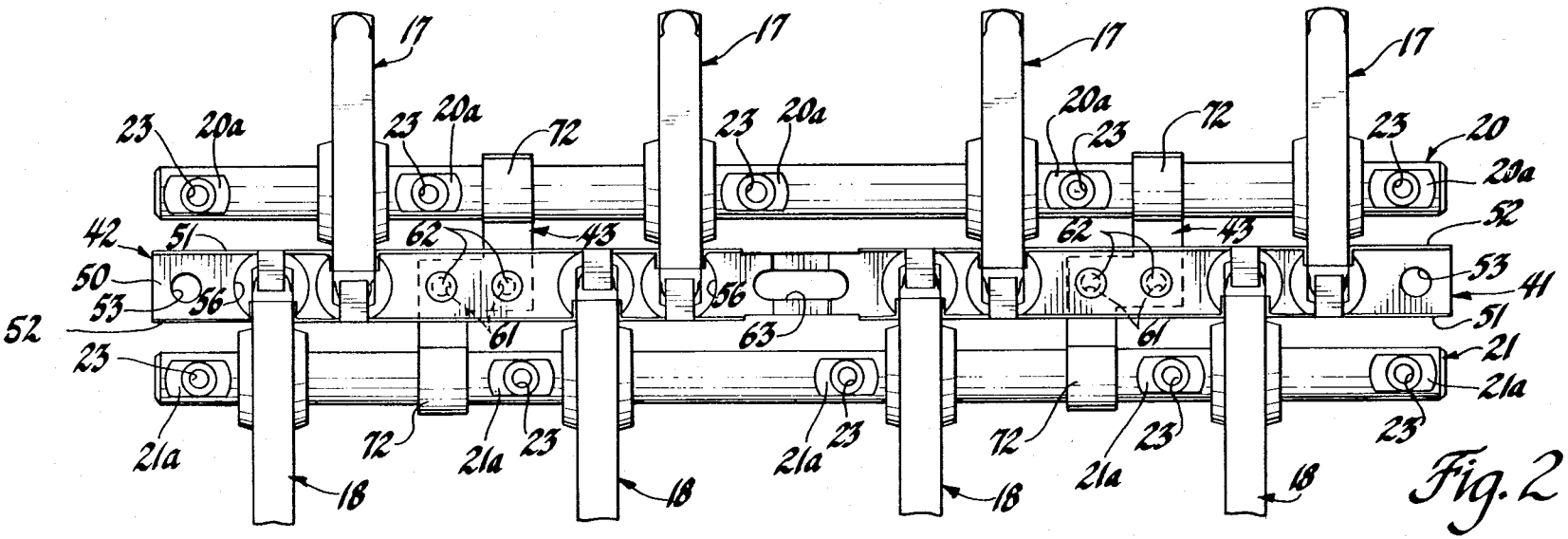
FIG. 2 is a top view of the valve train module, per se, of the valve train of the engine shown in FIG. 1.
Figure 3:
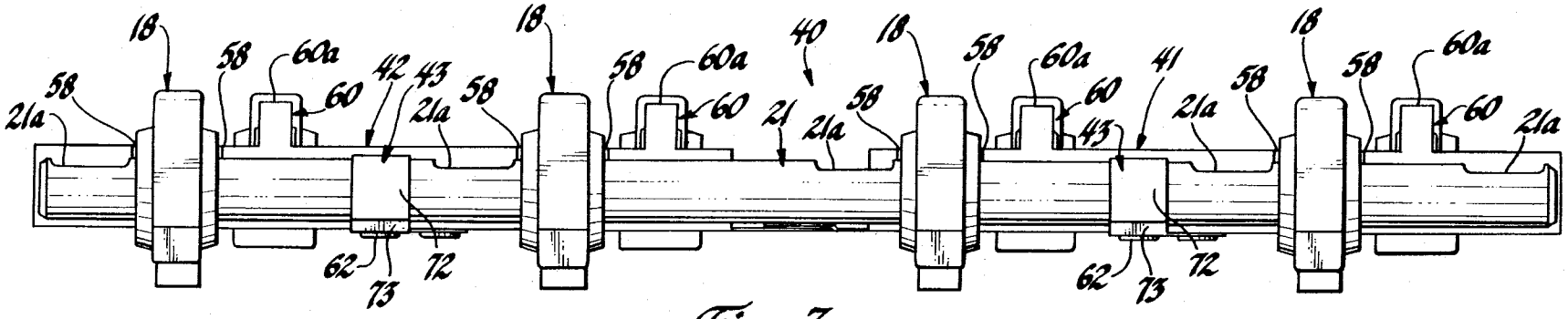
FIG. 3 is a side view of the valve train module, per se, of FIG. 2.

As conventional the rocker shafts 20 and 21 are supported in parallel relationship on upstanding rocker shaft pedestals 22 located in spaced apart relationship along the longitudinal extent of the cylinder head 1 and are fixed thereto as by bolts, not shown, received in through apertures 23 located so as to extend through the upper flat machined surfaces 20*a* and 21*a* on the rocker shafts 20, 21, respectively, as shown in FIG. 2.

In the construction shown, the rocker arms 17 and 18 are of identical configuration and, the rocker shafts 20 and 21 are also of identical configuration, except that, as mounted, the rocker shaft 21 is rotated 180 degrees relative to rocker shaft 20.

Each of the rocker arms 17 and 18 are individually actuated by an associate hydraulic lash adjuster lifter in the form of a conventional, hydraulic roller lifter, generally designated 25. An in-line plurality of suitably spaced apart vertical lifter guide bores 26 are provided in an upstanding, longitudinal extending boss 27, with each such guide bore 26 having a hydraulic roller lifter 25 journaled therein for reciprocation by an associate cam, not shown, of an engine driven camshaft, not shown, that is suitably journaled for rotation in the cylinder head 1 in a manner well known in the art. As shown, the boss 27 is provided with at least one oil gallery 28 supplied with engine lubricating oil in a conventional manner for supplying hydraulic fluid to the hydraulic roller lifters 25.

As conventional, each hydraulic roller lifter 25 includes a hollow cylindrical follower body 30 closed at one end, the lower end with reference to FIG. 1, with a hollow piston 31 journaled therein, with the upper end of the piston 31 being partly enclosed by a seat member 32 against which the hardened tip end 33 of the actuator arm end 34 of an associate rocker arm 17 or 18 engages. As shown, the upper or open end of the follower body 30 is provided with a set of opposed flats 30*a* on its exterior surface. Since the hydraulic roller lifters 25 do not per se constitute a part of the subject invention, it is not deemed necessary to describe this type lifter in greater detail since the internal structure and the function of such hydraulic lash adjuster type lifters are well known as disclosed, by way of one example, in U.S. Pat. No. 3,139,078 issued Jun 30, 1964 to Louis J. Van Slooten, the disclosure of which is incorporated herein by reference thereto.

Referring now to a feature of the invention a rocker positioner and non-rotation guide, generally designated 40, is operatively associated to support the rocker shafts 20, 21 and to position the rocker arms 17 and 18, respectively, thereon to provide for a valve train module and, as assembled to the cylinder head 1, to prevent rotation of the hydraulic roller lifters 25.

Figure 4:
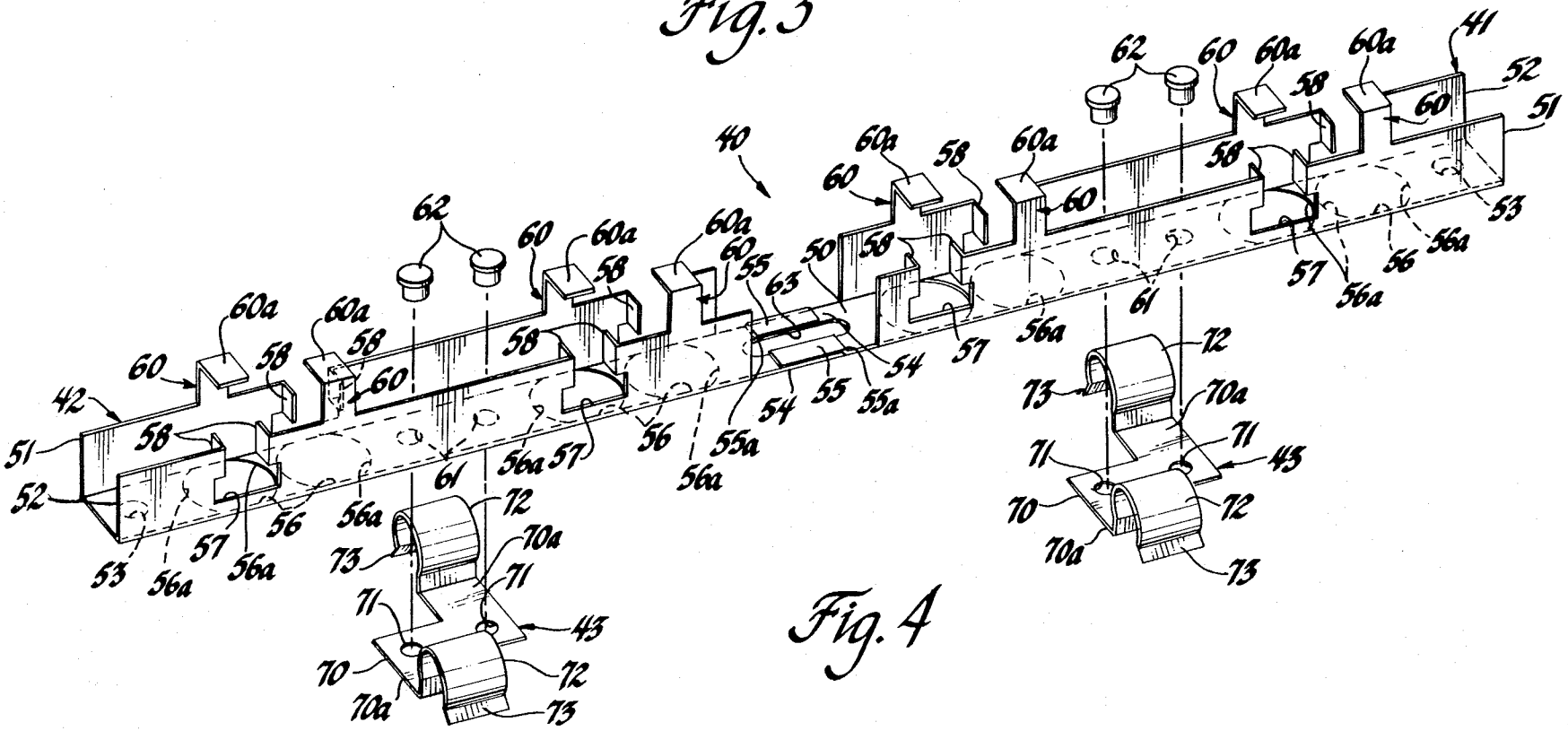
FIG. 4 is an exploded perspective view of the rocker positioner and lifter anti-rotation device, per se.

In the embodiment shown and as best seen in FIG. 4, the rocker positioner and non-rotation guide 40 made, for example, of sheet metal is formed as a multiple piece assembly that includes first and second rocker/non-rotation members 41 and 42, respectively, and a pair of rocker shaft supports 43 suitably secured together in a manner to be described.

The first rocker non-rotation member 41 of somewhat U-shaped configuration includes a longitudinally extending base 50 having integral upright legs 51 and 52 on opposite sides thereof and formed at substantially right angles thereto with the spacing between those legs 51 and 52 being selected to slidably receive the opposed flats 30*a* of the follower body 30 of the hydraulic roller lifter 25. The base 50 of the member 41 at one end thereof is provided with a central aperture 53 to receive a fastener, not shown, by which it can be secured to the boss 27 of the cylinder 1. At the opposite end, this base is bifurcated to define a flat finger 54 in the normal plane of the base 50 and a raised finger 55 elevated above the normal plane of the base 50 by an amount substantially equal to the thickness of the material of the base 50. The raised finger 55 as connected to the base 50 thus defines a stop shoulder 55*a*.

Intermediate its ends, this base 50, in the construction shown, is provided with two spaced apart sets of apertures 56, with each aperture defined in part by two opposed semi-circular segments 56*a* whose edges terminate at the legs 51 and 52, the nominal, internal diameter between such segments 56*a* being suitably greater than the external diameter of the follower body 30 of the hydraulic roller lifter 25 whereby each such aperture 56 is adapted to loosely, slidably permit reciprocation of the follower body 30 of an associate hydraulic roller lifter 25, while the opposed legs 51, 52 serve as anti-rotation means for the lifter.

The leg 51, adjacent to each of the first and third apertures 56, counting from the bifurcated end of the base 50, is pierced to define a rectangular opening 57, the bottom edge defining this opening being located a predetermined extent above the base 50 and the material of the leg 51 is bent to define a pair of suitably spaced apart rocker guide flanges 58 that are bent at right angles to the leg 51 so as to extend laterally inward over the associate aperture 56 so as to maintain the operative position of an associate rocker arm. In addition, the leg 51, adjacent to each the second and fourth apertures 56, is provided with an associate integral upstanding, inverted L-shaped arm 60 bent such that its leg 60*a* extends laterally inward at a predetermined height over the base 50 and the associate aperture 56 whereby to define a pivotable stop for an associate rocker arm during assembly and shipment, while still permitting normal pivotal movement of the rocker arm when mounted on the cylinder head 1, as shown in FIG. 1 to effect normal opening and closing movement of an associate valve, such as the inlet valve 11 as shown in this Figure.

The leg 52, adjacent to each of the second and fourth apertures 56, counting again from the bifurcated end of the base 50, is also pierced to define a rectangular opening 57 the bottom edge defining this opening being located a predetermined extent above the base 50 and the material of the leg 52 is bent to also define a pair of spaced apart rocker guide flanges 58. In addition, the leg 52, adjacent to each of the first and third apertures 56 is provided with an associate integral upstanding, inverted L-shaped arm 60 bent such that its leg 60*a* extend laterally inward at a predetermined height over the base 50 and the associate aperture 56 so as to define a stop for pivotal movement of an associate rocker arm for the purpose previously described.

Also as shown, the base 50 of the first rocker non-rotation member 41 is provided intermediate the two sets of apertures 56 with a pair of spaced apart apertures 61 whereby an associate rocker shaft support 43 can be suitably secured thereto and on the underside thereof, for example, as by rivets 62.

For this purpose, each rocker shaft support 43 is formed with a flat base 70 having a pair of apertures 71 spaced apart to conform to the spacing of the apertures in the base 50. The base 70, at opposite sides and ends thereof have integral laterally extending base legs 70*a* each of which terminates in an upstanding semi-circular spring clip 72 of a suitable, as formed, nominal diameter whereby such a spring clip 71 can be snapped onto an associate rocker shaft 20 or 21 so as to securely grip and support that rocker shaft. As shown, and as best seen in FIG. 4, each such spring clip at its free end is preferably provided with an outturned cam ram surface portion 73 to assist in guiding a rocker shaft into the spring clip 71.

The second rocker/non-rotation member 42 and its associate rocker shaft support 43 are identical, in structure and their assembly, to the first rocker/non-rotation member 41 and its associate rocker shaft support 43 and, accordingly, it is not deemed necessary to describe the second rocker/non-rotation member 42 and its associate rocker shaft support 43 in detail.

However, as shown in FIGS. 2, 3, 4 and 5, as assembled, the second rocker/non-rotation member 42 is reversed 180 degrees relative to the first rocker/non-rotation member 41 and then abutted thereagainst so that the raised finger 55 of the first member 41 overlies the flat finger 54 of the second member 42 and, of course, the raised finger 55 of the second member 42 will overlie the flat finger 54 of the first member 41. As thus joined together, these spaced apart overlapping sets of fingers 54 and 55 define an elongated aperture 63 to receive a suitable fastener, not shown, used to secure the center portion of the rocker positioner and non-rotation guide 40 to the boss 27 of the cylinder head.

Figure 5:
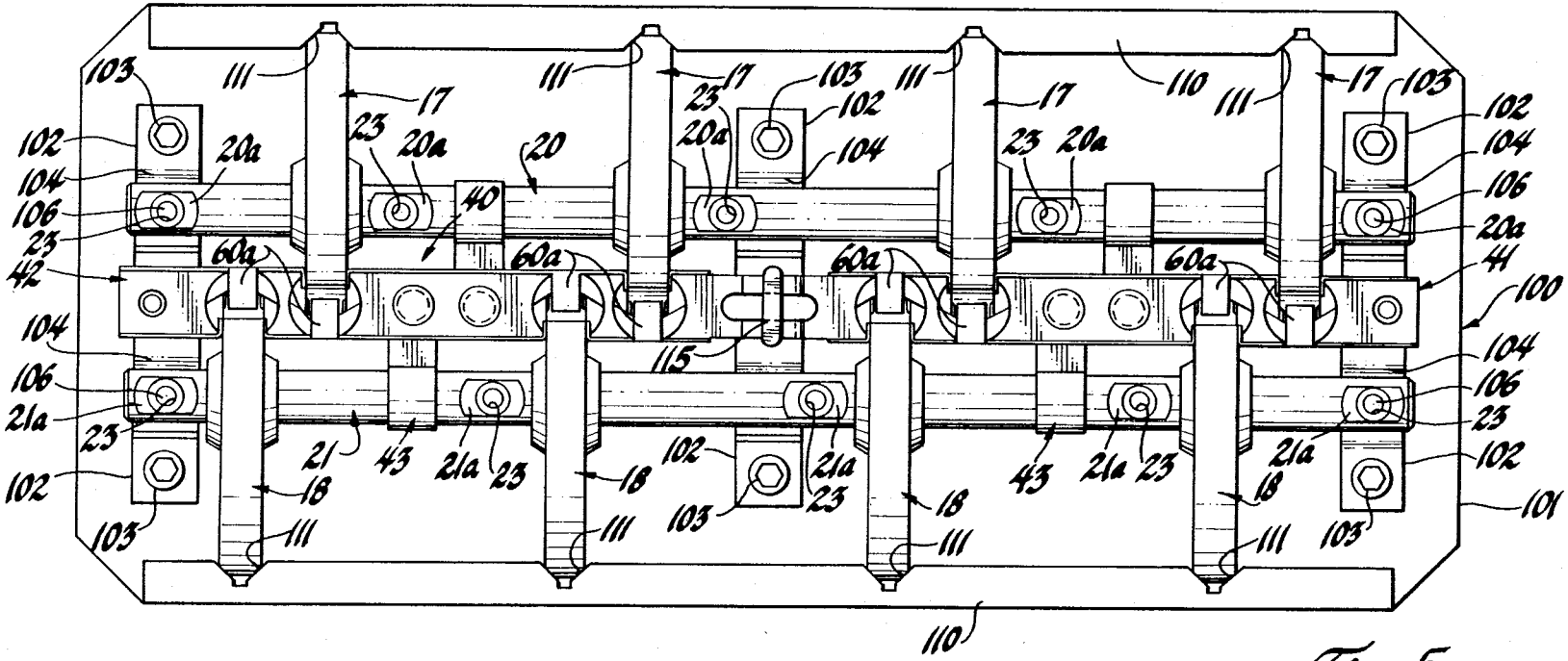
FIG. 5 is a top view of the valve train module, per se, as mounted in a shipping pallet; and, FIG. 6 is an end view of the valve train module and the assembly and shipping pallet of FIG. 5.
Figure 6:
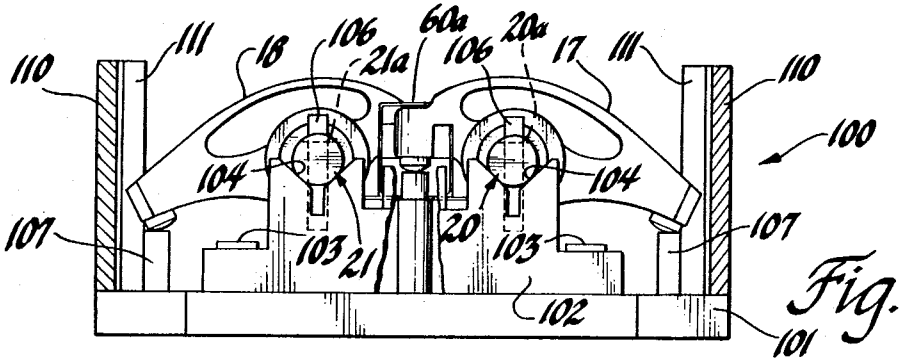

Referring now to FIGS. 5 and 6, there is shown a shipping pallet, generally designated 100, which is structurally similar to an assembly fixture used to assemble the valve train module with rocker positioner and non-rotation guide 40 of the subject invention, in the construction shown, that is used as one form of a shipping container for the subject valve train module.

The shipping pallet 100 includes a base 101 having upright supports 102 fixed as by fasteners 103 adjacent to opposite ends of the base and, preferably an addition one such upright support 102 is located centrally of the outboard supports 102. As best seen in FIG. 6, each of the upright supports 102 is provided with spaced apart V-grooves 104 sized to receive the rocker shafts 20 and 21 and a central rectangular cut-out portion 105. In the outboard upright supports 102, a suitable diameter guide pin 106 is fixed so as to extend centrally upward in each of the respective V-grooves 104 so as to be received in the outboard apertures 23 of the rocker shafts 20 and 21.

In the construction shown and as best seen in FIG. 6, there is provided a plurality of spaced apart vertically extending support pins 107 that are suitably fixed to the base 101 on opposite sides thereof to support the valve actuator end of the rocker arms 17 and 18, with these pins 107 being located inboard of the parallel side walls 110 suitably fixed to the base 101. As shown, each of the side walls is provided with spaced apart V-shaped vertical notches 111 located so as to receive the valve actuator end of an associated rocker arm 17 or 18.

In the construction illustrated and as best seen in FIG. 6, a central longitudinal extending pedestal 112 is suitably fixed to the base 101, the pedestal 112 having spaced apart circular bosses 114, with each such boss 114 extending up through an associate aperture 56 in the rocker positioner 40 to a predetermined height so as to support the opposite end of an associate rocker arm 17 or 18. In addition a ¼ turn spring loaded toggle clamp 115 is operatively associated with the pedestal at a location so as to extend through the aperture 63 of the rocker positioner 40 whereby it can be rotated to the position shown in FIG. 5 to effect clamp down of first and second rocker/non-rotation members 41 and 42, respectively.

It should however be realized that, if desired, the pedestal 112 can be eliminated since the legs 60*a* of the first and second rocker/non-rotation members 41 and 42, respectively, will operate to limit pivotable movement of the rocker arms 17 and 18, as mounted and supported in the pallet 100.

It will also be apparent to those skilled in the art that although the shipping pallet 100 has been shown and described as being formed of separate elements whereby it is structurally and functionally similar to an assembly fixture used to assemble the various elements of the subject valve train module with rocker positioner and non-rotation guide, the shipping pallet can be simplified so that it could be formed as a molded plastic shipping pallet.

While the invention has been described with reference to the structures disclosed herein, it is not confined to the specific details set forth, since it is apparent that many modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. A valve train with rocker positioner and non-rotation guide that is adapted to be assembled as a valve train module, tested, shipped and then mounted to the cylinder head of an internal combustion engine in position to effect operation of the inlet and exhaust valves associated with the cylinder head via rocker arms pivotably supported on a first rocker shaft having axially spaced apart mounting apertures therethrough and via rocker arms pivotably supported on a second rocker shaft having axially spaced apart mounting apertures therethrough, said rocker arms being adapted to be actuated by an engine driven camshaft of the engine via hydraulic roller valve lifters, each such valve lifter having guide flats on opposite sides thereof, said rocker positioner and non-rotation guide includes a longitudinally extending U-shaped positioner and non-rotation means and at least two longitudinally spaced apart, laterally extending, rocker shaft supports each of which at their opposed outboard ends are in the form of a spring clip whereby said rocker shaft supports are adapted to support and retain said first and second rocker shafts in spaced apart, parallel relationships to each other and to said U-shaped positioner and non-rotation means, said U-shaped positioner and non-rotation means including a base and integral first and second upright wall means on opposite sides thereof, said base having bolt receiving apertures therethrough for attachment to a cylinder head and spaced apart apertures corresponding in number to the number of said hydraulic roller valve lifters that are each sized so as to slidably receive an associate hydraulic roller valve lifter with said first and second upright wall means defining spaced apart flats operatively associated with the guide flats on said hydraulic roller valve lifters to prevent rotation thereof, each of said first upright wall means and said second upright wall means having a plurality of pierced openings each of which is defined in part by a pair of spaced apart, inward extending rocker positioner flanges to slidably receive and position an associate rocker arm on said first rocker shaft and on said second valve shaft, respectively.

2. A valve train with rocker positioner and non-rotation guide according to claim 1 wherein said first upright wall means includes upstanding inverted L-shaped arms with each having a leg extending between and toward an associate opposite set of rocker positioner flanges on said second upright wall means and wherein said second upright wall means includes upstanding inverted L-shaped arms with each having a leg extending between and toward an associate opposite set of rocker positioner flanges on said first upright wall means, each of said legs being located to limit pivotal movement of an associate rocker arm in one direction.

3. A valve train with rocker positioner and anti-rotation guide that is adapted to be assembled as a valve train module, tested, shipped and then mounted to the cylinder head of an internal combustion engine in position to effect operation of the inlet and exhaust valves associated with the cylinder head via rocker arms pivotably supported on a first rocker shaft having axially spaced apart mounting apertures therethrough and the rocker arms pivotably supported on a second rocker shaft having axially spaced apart mounting apertures therethrough, said rocker arm assemblies being adapted to be actuated by an engine driven camshaft of the engine via hydraulic lifters each of which includes a follower body with opposed guide flats at one end thereof, said rocker positioner and anti-rotation guide including a U-shaped member with shaft retainer means thereon to effect retention of said first rocker shaft and said second rocker shaft in spaced apart parallel alignment with respect to each other; said U-shaped member having a base and spaced apart side walls having spaced apart opening defined in part by spaced, inturned rocker guide flanges to effect and retain a predetermined axial operative position of said rocker arms on a respective associate said first rocker shaft and said second rocker shaft; anti-rotation means on said side walls located so as to maintain the angular position of said rocker arm at a position corresponding substantially to the operative position of each of said rocker arm as installed on the cylinder head of an engine; and, said base having spaced apart fastener receiving apertures whereby it can be fixed to a cylinder head, said rocker positioner and said anti-rotation guide being operative to support said first and second rocker shafts to retain said rocker arms thereon together as a valve train module and then to permit attachment of said rocker positioner and anti-rotation guide and said first and second rocker shafts with the rocker arms thereon to the cylinder head of an engine whereby said valve train module will be secured in position to effect operation of said inlet and exhaust valves.

* * * * *